US010422156B1

(12) United States Patent
Morrow

(10) Patent No.: US 10,422,156 B1
(45) Date of Patent: Sep. 24, 2019

(54) LIGHTWEIGHT CONCRETE OR MASONRY FENCE SYSTEM WITH OPTIONAL CONCRETE FOOTINGS

(71) Applicant: Blue Tomato LLC, Provo, UT (US)

(72) Inventor: Brian D. Morrow, Provo, UT (US)

(73) Assignee: Blue Tomato LLC, Provo, UT (US)

( * ) Notice: Subject to any disclaimer, the term of this patent is extended or adjusted under 35 U.S.C. 154(b) by 0 days.

(21) Appl. No.: 15/995,403

(22) Filed: Jun. 1, 2018

Related U.S. Application Data

(63) Continuation-in-part of application No. 14/704,745, filed on May 5, 2015, now abandoned.

(51) Int. Cl.
*E04H 17/16* (2006.01)
*E04H 17/22* (2006.01)
*E04H 17/14* (2006.01)

(52) U.S. Cl.
CPC ..... *E04H 17/168* (2013.01); *E04H 17/22* (2013.01); *E04H 2017/1447* (2013.01)

(58) Field of Classification Search
CPC ... E04H 17/1404; E04H 17/16; E04H 17/165; E04H 17/166; E04H 17/168; E04H 17/22
USPC ..... 256/19, 24, 31, 73
See application file for complete search history.

(56) References Cited

U.S. PATENT DOCUMENTS 1,714,949 A 5/1929 Collier
2,574,711 A 11/1951 Rose
3,193,255 A 7/1965 Burdett
3,503,589 A 3/1970 Moore
3,512,759 A 5/1970 Resler
3,555,751 A 1/1971 Thorgusen
3,617,028 A 11/1971 Bach
3,691,708 A 9/1972 Firnkas
3,933,969 A 1/1976 Robinson
4,007,919 A * 2/1977 Totten ..... E04H 17/168 256/59
4,037,788 A 7/1977 Riley
(Continued)

FOREIGN PATENT DOCUMENTS

JP 9279605 10/1997
JP 11323970 11/1999
WO 9202701 2/1992

OTHER PUBLICATIONS

U.S. Appl. No. 14/704,745, Aug. 9, 2017, Office Action.
U.S. Appl. No. 14/704,745, Feb. 1, 2018, Office Action.

*Primary Examiner* — Josh Skroupa
(74) *Attorney, Agent, or Firm* — Workman Nydegger

(57) ABSTRACT

Column and panel concrete fence systems and related methods of construction. Such a method may include placing posts into respective concrete footings, and attaching a 4-arm bracket to each post. The concrete column may be provided in two initially separate portions e.g., each corresponding to a "front" or "back" face of the fence. One of the portions (e.g., corresponding to the front or back of the fence) is attached to a given post, supported on one lateral arm of each bracket. The concrete panel may then be advanced into place, and the other portion of the column is attached to the post, over the first column portion that was already attached to the post. The $2^{nd}$ portion of the concrete panel is supported on the other lateral arm of the brackets. The panel itself is supported on a middle arm of the bracket, between the lateral column-supporting arms.

17 Claims, 7 Drawing Sheets

(56) References Cited

U.S. PATENT DOCUMENTS 4,193,584 A 3/1980 Wieser
4,239,176 A 12/1980 Salazar
4,481,743 A 11/1984 Jellen
4,605,090 A 8/1986 Melfi
5,100,107 A 3/1992 Latta
5,158,399 A 10/1992 Flores
5,218,797 A 6/1993 Kruse
5,233,810 A 8/1993 Jennings
5,404,685 A 4/1995 Collins
5,406,039 A 4/1995 Rerup
5,501,057 A 3/1996 Dawson
5,509,249 A 4/1996 House
5,524,405 A 6/1996 Byrd
5,580,480 A 12/1996 Chatelain
5,623,797 A 4/1997 Gravier
5,649,689 A 7/1997 Wilson
5,702,627 A 12/1997 Brasken
5,867,964 A 2/1999 Perrin
5,887,404 A * 3/1999 Kreizinger ..... B28B 7/20 256/19
5,984,044 A * 11/1999 Christensen ..... E01F 8/0023 181/210
6,199,832 B1 3/2001 Morrow
6,398,193 B1 6/2002 DeSouza
6,609,347 B2 8/2003 Morrow
7,165,916 B2 * 1/2007 Nanayakkara ..... E02D 5/36 405/285
7,454,870 B2 * 11/2008 Greenberg ..... E04H 17/1404 52/293.2
7,478,797 B2 * 1/2009 Laws ..... E04H 17/168 256/19
7,546,900 B2 * 6/2009 Humphries ..... E04H 17/168 181/284
7,635,114 B2 * 12/2009 Laws ..... E04H 17/168 256/19
7,637,062 B2 * 12/2009 Rerup ..... E01F 8/0023 181/210
7,802,409 B2 * 9/2010 Stott ..... E04H 17/168 52/295
8,162,638 B2 * 4/2012 Stott ..... B28B 7/002 249/112
9,506,270 B2 * 11/2016 Knudsen ..... E04H 17/165
2011/0197533 A1 8/2011 Morrow
2016/0326769 A1 11/2016 Morrow

* cited by examiner

LIGHTWEIGHT CONCRETE OR MASONRY FENCE SYSTEM WITH OPTIONAL CONCRETE FOOTINGS

CROSS-REFERENCE TO RELATED APPLICATION

This Application is a continuation-in-part of U.S. patent application Ser. No. 14/704,745, filed May 5, 2015, the entirety of which is herein incorporated by reference.

BACKGROUND OF THE INVENTION

1. The Field of the Invention

The present invention is in the field of modular concrete fence systems formed from a plurality of concrete panels and columns.

2. The Relevant Technology

Column and panel concrete fence systems are commonly employed within the field. Such fencing typically includes a plurality of concrete panels oriented end to end, with a column positioned between adjacent panels. Various methods are known for constructing such a fence. For example, typically, a concrete footing is provided for each column, after which the panels and columns may be positioned thereover, so that the load of the panels and columns is supported by the footings. Such footings are typically dug to the needed depth, and then filled with concrete. Once the concrete has hardened sufficiently, the columns and panels may be positioned over the completed concrete footings. Depending on the particular method employed, it may also be necessary to fill or "grout" voids that may be intentionally included within the column with concrete as well, once the columns and panels are in place. Such methods require excavation of the dirt from the footing hole, which dirt must often be hauled away, followed by pouring of concrete into the prepared holes. Placement of the panels and columns cannot be accomplished immediately, and must be postponed until the concrete footing has sufficiently hardened. The time, effort, and expense involved in excavation, concrete pouring, waiting for the concrete to cure, and grouting of columns is significant.

Examples of such existing concrete panel and column fence systems and methods for their construction are described in the inventor's earlier U.S. Pat. Nos. 6,199,832 and 6,609,347, each of which is herein incorporated by reference in its entirety. It would be an advancement in the art to provide concrete panel and column fence systems that could be installed with greater ease, less time, and less expense. Some embodiments of such a system may not specifically require any excavation or concrete footings. Other embodiments may employ concrete footings.

SUMMARY

In one aspect, the present invention is directed to methods for constructing a column and panel concrete fence. Such a method may include placing a plurality of posts into the ground, attaching a bracket to each post, attaching a first portion of a concrete column to each post, and placing a concrete panel on the brackets of adjacent posts such that a first end of the panel is supported on the bracket of one post, and a second end of the panel is supported on the bracket of the adjacent post. A second portion of each concrete column may be attached to its corresponding post. For example, the concrete column may be provided in two initially separate portions or halves, e.g., each corresponding to a "front" or "back" face of the fence. One of the portions (e.g., corresponding to the front or back of the fence) is attached to a given post. The concrete panel may then be advanced into place, and the other of the front or back portions of the column may then be attached to the post, over the already attached column portion.

In another embodiment, the method includes placing a plurality of posts in the ground. In some embodiments, the posts may be pounded or otherwise driven in the ground, without the use of any concrete footing. In another embodiment, a concrete footing may be provided, with the post in the concrete footing. A bracket may be attached to each post, which bracket will be used to support the concrete panel of the fence. A first portion of the concrete column may be attached to each post, with the first portion of the concrete column corresponding to a front or rear face of the fence system. A lightweight concrete panel (e.g., no more than about 500 lbs, e.g., about 250 lbs) may be placed on the brackets of adjacent posts, so that a first end of the panel is supported on the bracket of one post, and a second end of the panel is supported on the bracket of the adjacent post. Because the concrete panel is lightweight (e.g., including a foam core), it is possible to support the weight of the panel on the brackets, which are attached to the posts. It is not necessary to place and support the concrete panel directly on a concrete footing, as is traditionally done, even is such a footing is present. In an embodiment, where such a footing is present, the panel may specifically be placed on the bracket, above, and not contacting the footing at all (i.e., with a space between the bottom of the bracket and the footing). A second portion of the concrete column may be attached to the corresponding post, at a location on the post opposite the first portion of the concrete column. For example, the second portion of the concrete column corresponds to the other of the front or rear face of the fence.

Where the first portion of the concrete column is attached to the post, this may be followed by advancement of the concrete panel into position on the brackets, laterally, from the side (as opposed to from above). Once the panel is in place, the opposite second portion of the concrete column may be attached to the post, which already includes the first portion of the concrete column attached thereto. Such a method is particularly advantageous, as it does not require that the concrete panel be lifted above the columns, and dropped down into a corresponding slot within the columns. Instead, the panel is sandwiched between the facing column portions by placing one column portion, positioning the panel, and then placing the other column portion.

Another aspect of the present invention is directed to a column and panel concrete fence including a plurality of posts (e.g., in a concrete footing or directly in compacted ground without a footing), a column attached to each post, each column including two portions which are separate from one another, and which correspond to front and rear faces of the fence, respectively. A lightweight concrete panel is included, with a first end of the panel supported by a bracket attached to one of the plurality of posts such that the first end of the panel extends between the portions of the column and a second end of the panel being supported by a bracket attached to an adjacent one of the plurality of posts, such that the second end of the panel extends between the portions of the column attached to the adjacent post. In other words, the ends of the panel are sandwiched between the column portions.

Such methods and fence systems do not require supporting the fence panel on a concrete footing (even if one is present). This is possible because of the use of relatively lightweight materials in constructing the panels of the fence, while at the same time providing actual exterior surfaces (e.g., veneers) to the panels that are concrete. Normally, a concrete panel fence is very heavy, and it is necessary to support the load associated with typical concrete panel and concrete columns on the concrete footing. For example, a typical concrete panel (e.g., about 9 feet long, 6 feet high, and about 4 inches thick) may typically weigh 3,000 to 4,000 lbs. Such massive loads must be supported on a concrete footing.

Because of the need to support such a load on a concrete footing, it is also necessary to excavate the earth under the location of each of the fence columns. For example, in a traditional solid concrete panel fence system, holes are excavated at the spacing of the columns (e.g., about 9 feet apart). Each prepared hole is filled with concrete, which must be allowed to harden. After having hardened, the columns are constructed over the concrete footings, with the ends of the panels resting directly on the concrete footings (or on an optional bracket, such as in U.S. Publication No. 2011/0197533, sandwiched between a panel and the footing). Because the ends of the concrete panels rest directly on the concrete footings, it is important that such concrete footings be prepared so that their top surface is level, and at the desired height. As will be apparent, this can present difficulties, particularly where the fence is being constructed on a sloped surface, where it may be desired to "stair-step" the panels to accommodate the sloping surface. Such requires stair-steps to be incorporated into the top surface of the footings, as well. Even where concrete footings are used in the present embodiments, it is not critical that the height or leveling be perfect, as in conventional systems. Such flexibility simplifies the installation process.

Features from any of the disclosed embodiments may be used in combination with one another, without limitation. In addition, other features and advantages of the present disclosure will become apparent to those of ordinary skill in the art through consideration of the following detailed description and the accompanying drawings.

BRIEF DESCRIPTION OF DRAWINGS

The drawings illustrate several embodiments of the invention, wherein identical reference numerals refer to identical or similar elements or features in different views or embodiments shown in the drawings.

DETAILED DESCRIPTION OF THE PREFERRED EMBODIMENTS

I. Introduction

The present invention is directed to concrete panel and column fence systems, as well as methods for installing such fence systems. For example, the fence systems and methods provide for installation of a concrete panel and concrete column fence, which provides desired aesthetic and other benefits. In some embodiments, the present fence system can be installed without requiring the use of any concrete footings, or the excavation typically associated with such footing preparation. In other embodiments, footings may be used, although the light weight panels are not supported on the footing, and do not contact the footing. As such, it is typically not necessary to ensure that such footings are perfectly level or at a particular height. For example, there may be a space between the bottom of the bracket and the top of the footing, e.g., such as at least 1 inch (e.g., from 1 inch to 10 inches, or more).

II. Exemplary Fence Systems and Methods of Installation

Figure 1:
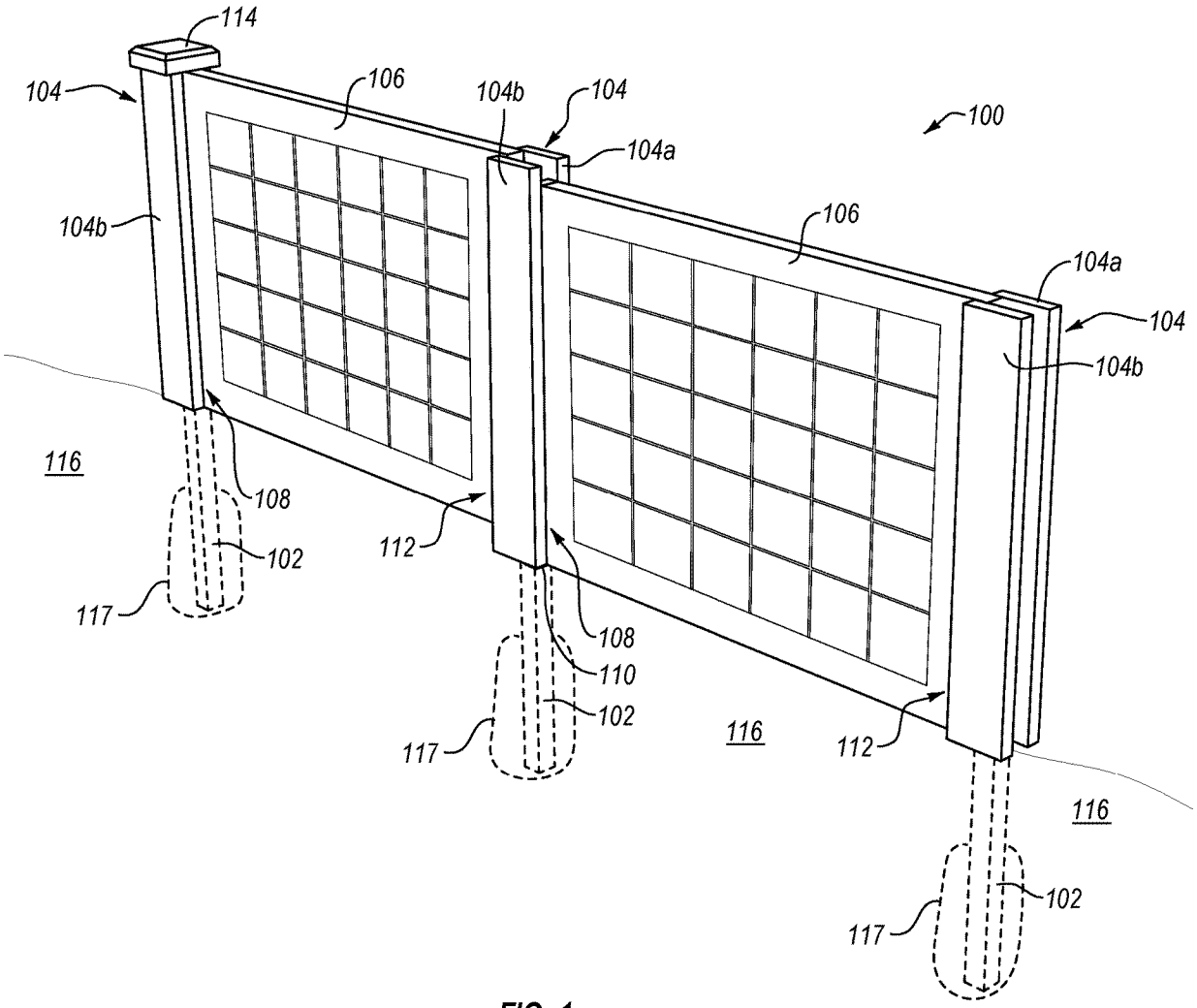
FIG. 1 is an isometric view of an exemplary fence system according to the present invention.

FIG. 1 shows an exemplary column and panel concrete fence 100 including a plurality of posts 102, a concrete column 104 attached to each post 102, in which each column 104 includes two initially separate portions 104*a* and 104*b*, and a lightweight concrete panel 106. As seen in FIG. 1, the two portions 104*a* and 104*b* of column 104 may correspond to front and rear faces of the fence 100, as shown. A first end 108 of concrete panel 106 is positioned and supported on a bracket 110, which bracket is attached to post 102. The brackets 110 are difficult to see in FIG. 1, and are perhaps best seen in FIGS. 3-6, which show progressive views of how the fence may be constructed, according to an embodiment. A second end 112 of panel 106 is also positioned on another bracket 110, so that the panel extends between two adjacent posts 102 of the fence system. The ends 108 and 112 of panel 106 are sandwiched between the two portions 104*a*, 104*b* of a given column 104.

The fence 100 thus includes columns 104 on either side of each panel 106, with adjacent columns being separated by the intervening panel. Where multiple panels are included, the panels are aligned end-to-end, with a column positioned at the respective ends of the two adjacent panels. The ends of the two panels do not need to contact one another, but will typically be spaced apart from one another by at least the width of the post 102. For example, the ends of each panel may abut and contact (or nearly contact) the corresponding post on which the bracket supporting that end of the panel is attached. As seen in FIG. 1, to provide a finished appearance, a cap 114 may be attached over each column 104.

By way of example, where the posts 102 and columns 104 are spaced 9 feet apart from one another, center to center, the panel itself may be somewhat less than 9 feet in width, e.g., about 101 inches, leaving a small gap between the ends of adjacent panels, with the post 102 disposed therebetween.

Posts 102 may be driven into the ground (e.g., dirt) 116, without requiring excavation. In another embodiment, posts may be positioned in footings 117, securing them in place. Each post 102 may include its own discrete footing, as shown. Because the fence panels are not supported or leveled on such footings, it is not required that such footings be particularly level, or at a particular height to ensure that the panel is level. This is so because the panel will be fully supported on a bracket, which will simply be screwed into post 102, at a desired height, and which attachment is forgiving, e.g., if misplacement occurs and replacement of the bracket (to level the panel) is needed.

In conventional construction, concrete footings are needed for such concrete panel and column fences, because of the great weight of the concrete panels, which may easily weigh in excess of 3,000 lbs each. A suitable foundation for supporting such a massive load must be provided, which is provided by the typical concrete footing. Pouring of such concrete footings is particularly time consuming and labor intensive, because of the need to ensure that such footings are level and at the proper height.

For example, the crew may come and form the footings the first day, and leave, returning the next day after the footings have hardened. The second day they can then place the concrete columns and panels and fill the void within the center of each column (e.g., which includes rebar running vertically up from the footing below) with concrete (i.e., "grouting the column"). Throughout this process, the panels and/or columns may require bracing until the concrete poured within the column has been allowed to harden. As will be apparent, this may typically require the installation crew to return again a third day once the grouted columns have hardened, as only then can the bracing be removed. In some embodiments, no bracing is required with the present embodiments, as grouting of columns is not required (although such is possible, if one so desired).

When pouring such conventional concrete footings, it is important that the top of the footing be level (as the panel will be resting thereon), and that it be at the proper height, so that the panels are each at a desired height. While stair stepping of the panels may be desired where installing the fence on a slope, generally, it is desired that the top of each panel be at the same height, so that the fence looks right (i.e., square and plumb). If care is not taken in pouring the concrete footings, the footings may be at different heights, where it is intended that they be at the same height, resulting in the top end of the fence as defined by the panels being uneven from panel to panel (i.e., it goes up and down, where such is not intended). Where the concrete footings are not at the proper height or are not level, this can require shaving or cutting away the top surface of the footing, or build up of a footing that is too short with specially formulated concrete capable of acceptable adhesion between the old and new concrete. Needless to say, such adjustments are time consuming, labor intensive, and add substantially to the cost of a project. Because the present embodiments do no rely on the panel resting on the concrete footing, it does not matter if the footings are not level, or are filled to different heights. Such characteristic greatly simplifies the installation process.

In some embodiments, no concrete footings may be used, but the posts may rather simply be driven into the compacted ground. Even in such an embodiment where one may wish to avoid use of concrete footings, a user may choose to use a concrete footing where the post might require placement at a location where it cannot readily be driven into the ground. An example of such an instance may be where the post must be placed in very rocky ground, where it may not be possible to pound or otherwise drive the post into the ground.

In any case, even if the posts are installed in a concrete footing, the footing is not required for column and panel support in the same way that such is required with a typical concrete panel and column fence. The footing is not required to support any massive load of the fence itself, but merely (in some circumstances) to secure the post itself in place. Even in such instances, the load is supported on the bracket attached to the post, not on the concrete footing. Because the load does not rest directly on the footing, it is not necessary to ensure that the footings are poured to be at a particular level from one footing to the next, nor is it required to ensure that the footings are level or smooth across their top face (e.g., an uneven "bumpy" surface is fine).

Figure 7:
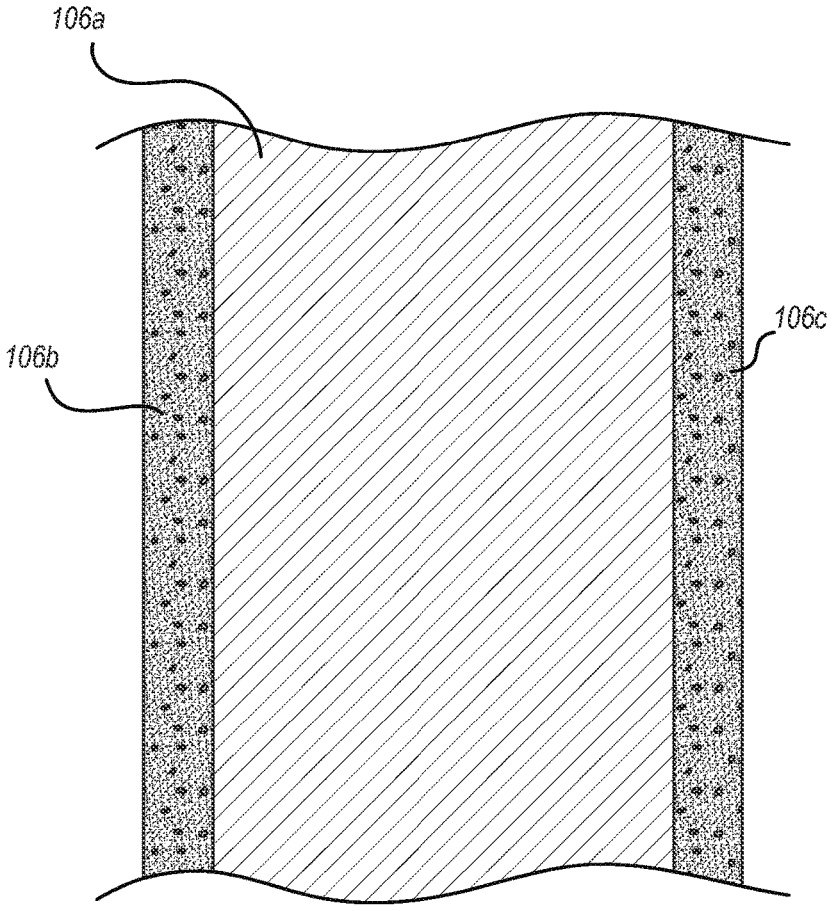
FIG. 7 shows a cross-section through an exemplary panel.

The presently disclosed fence system and method employs an alternative mechanism for supporting the fence structure (columns and panels) that reside above ground. Because the present fence system employs lightweight concrete panels, the panels weight far less than a similarly dimensioned solid concrete panel. For example, as shown in FIG. 7, each panel 106 may include a foam core 106*a* (e.g., about 2.5 inches thick), with a relatively thin concrete shell or veneer 106*b*, 106*c* that surrounds the foam core 106*a*. For example, the concrete shell may be about ⅜ inch thick, providing the concrete panel with an overall thickness of about 3 to about 4 inches. The foam core may comprise any suitable lightweight material, e.g., such as expanded polystyrene. Rather than weighing in excess of 3,000 lbs (for an approximately 9 foot long, 6 foot high panel), such a concrete panel may weigh no more than 500 lbs, no more than 400 lbs, no more than 300 lbs, e.g., from 200 to 300 lbs. Such a typical panel weighs about 250 lbs.

The columns may be formed from solid precast concrete, as their size is relatively small in comparison to that of the panels. Also, since the column is provided in two halves, the weight is further reduced to approximately 100 lbs. In another embodiment, the columns could be constructed with a lightweight foam core, surrounded by a relatively thin shell of concrete, similar to the panels. The thin shell of concrete and/or the concrete of the columns may be fiber reinforced, so as to provide the desired level of strength. The lightweight concrete fence system provides the aesthetic beauty characteristics of concrete (e.g., mimicking stone), providing weatherability and durability characteristics far greater than those available from plastic and wood fencing systems. Yet, because of the lightweight characteristics, installation and cost is much easier and lower cost as compared to traditional solid precast concrete panels.

Because the concrete panels are lightweight (e.g., showing about a 90% reduction in weight as compared to a similarly sized solid concrete panel), requirements for supporting the load of the panels is significantly different than when working with solid concrete panels. For example, the fence system may have a weight load of only about 400 lbs per post location, as compared to thousands of pounds (e.g., 4,000 lbs or more may be typical) per similar location (i.e., the concrete footing) associated with a traditional concrete fence system. Because of the much lower load characteristics, it is possible to replace the traditionally employed concrete footing support mechanism with a system of posts and brackets attached to the posts, on which the concrete panels and column portions are supported.

Figure 2:
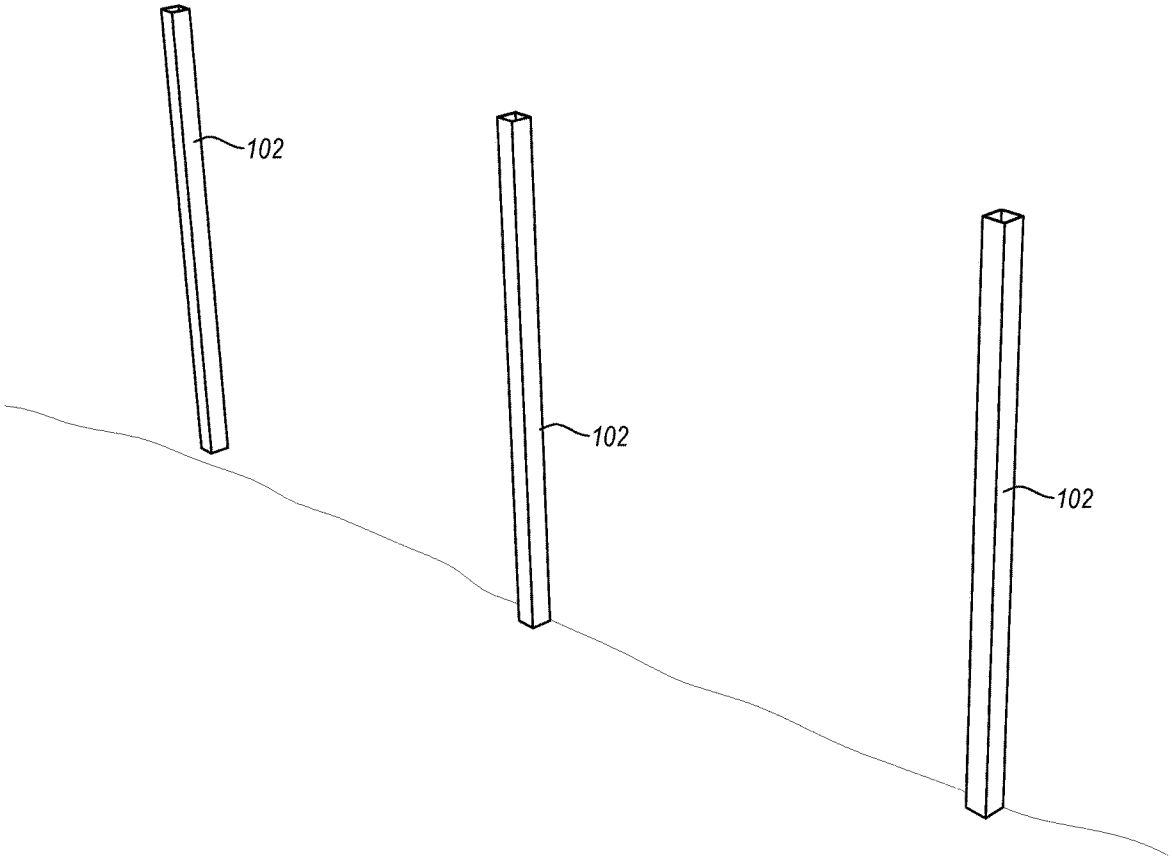
FIG. 2 shows posts to be placed in the ground, with or without any excavation or concrete footings.

FIGS. 2-6 illustrate steps of an exemplary method of installation. As seen in FIG. 2, the posts 102 may be placed into the ground (e.g., by pounding or otherwise driving them to the desired depth, or placement in a footing 217). The posts 102 may be spaced apart from one another an appropriate distance (e.g., 9 feet), depending on the particular length characteristics of the precast lightweight concrete panels. It will be apparent that other spacings may be provided, depending on the particular length dimension of the panels.

Both the panels and column portions may be precast, monolithic (single piece) in structure, providing for quick, easy, and inexpensive construction or assembly of the fence on site.

Each post 102 may be a rectangular cross-sectioned hollow post, as shown in FIG. 2, although other configurations might alternatively be employed while still providing a foundation on which to support the columns and panels. For example, a circular cross-sectioned post, or other polygonal shaped cross-section post may alternatively be employed. In an embodiment, the illustrated rectangular (e.g., square) cross-section is preferred). The posts 102 may be hollow, including open ends at each end, particularly if driving them into the ground. A pointed end could alternatively be provided. For example, the post may comprise a 4 inch square steel (e.g., galvanized) or other metal (e.g., aluminum) post.

Figure 3:
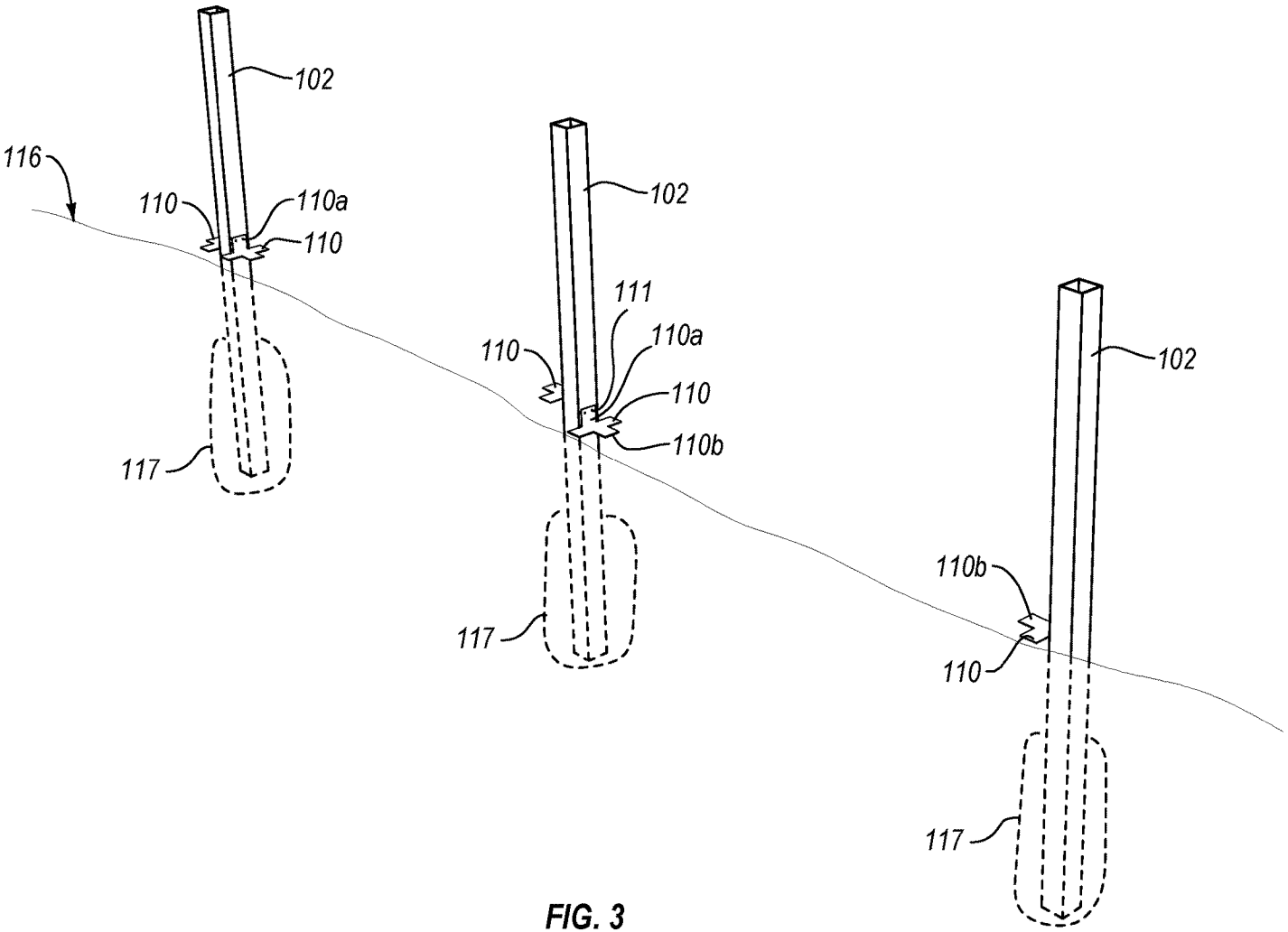
FIG. 3 shows attachment of a bracket to each post.

As shown in FIG. 3, once the posts 102 are positioned to a desired depth into the ground (e.g., footing 117), brackets 110 may be attached to each post 102. While shown screwed to posts 102, it will be appreciated that any other attachment mechanism for attaching the posts may be employed (e.g., welding, riveting, gluing with an adhesive, etc.). Care is taken to ensure that the brackets are attached at the appropriate height along each post 102, as the lightweight concrete panels will rest thereon. Nevertheless, it will be apparent that if a mistake is made in attaching a bracket too high or too low, this is easily remedied by removing the bracket and reattaching it at the appropriate height. It will be apparent that such corrective measures are far simpler and easier than correcting mistakes made in the height or leveling of the concrete footing in traditional concrete fence systems.

While bracket 110 is shown as being substantially + shaped, with 4 outwardly extending arms, each about 90° apart, it will be appreciated that any bracket configured to support the panel may be suitable for use. As shown, 3 of the 4 arms may be coplanar, while one of the arms of bracket 110 is shown being disposed at a 90° upward angle relative to the horizontal plane defined by the other arms. As shown in FIG. 3, this vertical arm 110*a* of bracket 110 may be screwed into or otherwise attached to post 102 (e.g., using screws 111). Arm 110*a*, and/or each of the other arms of bracket 110 may be of a width approximately equal to that of the post 102, as shown. For example, where the post is about 4 inches in width, bracket arm 110*a* may also be about 4 inches in width.

Arm 110*b* opposite arm 110*a* may extend towards the next, adjacent post 102. The panel may be supported on arm 110*b* of the bracket 110, e.g., with one end 108 of the panel 106 supported on arm 110*b* of bracket 110 (e.g., attached to the center post seen in FIG. 3), while the other end 112 of panel 106 may be supported on arm 110*b* of the other bracket 110, attached to the adjacent post (e.g., the right most post seen in FIG. 3). The arms defined between arms 110*a* and 110*b*, which extend in a direction corresponding to the "front" and "rear" faces of the fence may also aid in supporting the ends 108 and 112 respectively, although more typically they may support or interface with the column portions 104*a* and 104*b*, respectively. Brackets 110 are generally hid from view once the fence is fully constructed (e.g., see FIG. 1), as arm 110*b* may be under the bottom of panel end 108 or 112, arm 110*a* is hidden within column 104, and the front and rear arms are also generally hidden by column portions 104*a* and 104*b*. This is so particularly where the brackets 110 are installed near ground level 116, so as to not be readily seen by a person standing up.

As is apparent from the Figures, brackets 110 are positioned along a height of each post 102, not at an end of post 102. For example, brackets 110 are positioned to be above a top surface of the ground, or the concrete footing 117, so as to provide a space (e.g., at least 0.5, or at least 1 inch) therebetween. In this way the weight of panel 106 and columns 104 are not supported on the footing, but entirely on the arms of bracket 110.

The bracket 110 may be attached to the respective post 102 as shown, with the bracket not extending about the post, but attached at only one side thereof (e.g., oriented towards the next, adjacent post), to support a panel extending between such posts. The arms between arm 110*a* and 110*b* extend laterally outward, orthogonally from the vertical plane defined by the fence panel 106. Such lateral arm extensions support the column portions 104*a* and 104*b*, respectively.

As will be apparent from the center post 102 of FIG. 3, the brackets 110 attached on either side of post 102 may be attached at different heights to accommodate a step in the fence, where the ground is sloped. Where the ground is generally level, the brackets on either side of a given post 102 may be at the same height. At the end of a fence, the brackets 110 may only be installed on one side of the post. Where the fence forms a corner, the brackets may be attached on adjacent sides (e.g., 90° apart, rather than the 180° seen on the center post of FIG. 3). Other configurations to accommodate a desired fence design will be apparent from the present disclosure.

Figure 4:
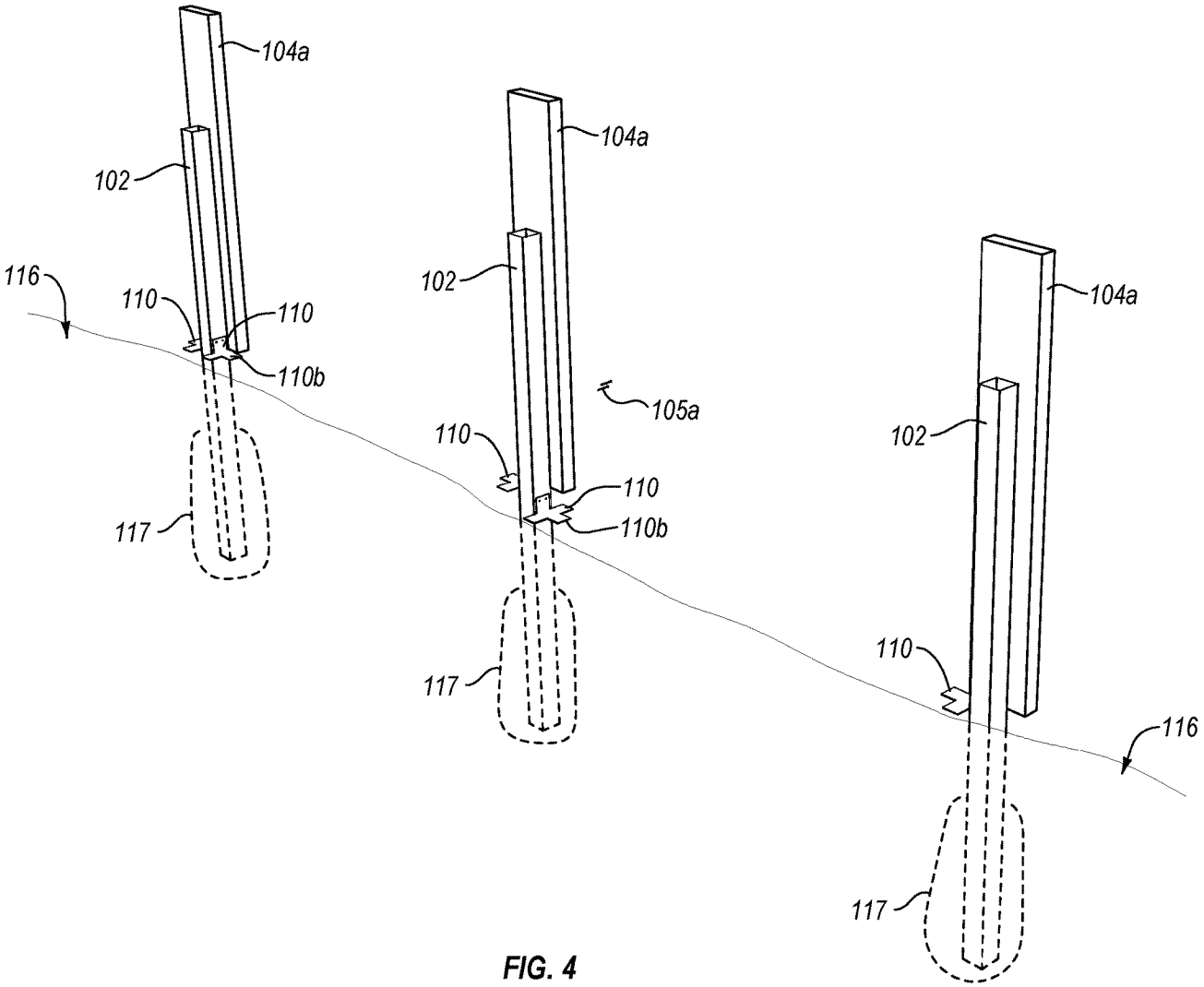
FIG. 4 shows the first portion of the two-part fence column being attached to (e.g., screwed into) the post.

As shown in FIG. 4, a first portion 104*a* of each column 104 may be attached to the corresponding post 102. Each column portion may be attached using any suitable mechanism. It may be attached by screwing, welding, riveting, gluing with an adhesive, combinations thereof, etc. In an embodiment, attachment may be by structural self-tapping screws, e.g., including a hardened tip and more ductile threads, which provides for excellent shear strength. For example, pilot holes may be drilled through the column portions, and the structural self-tapping screws 105*a* may be screwed through the pilot holes, which self-tap into the metal post 102. Other suitable attachment mechanisms will be apparent to those of skill in the art.

When placing the post 102, it is desired to ensure that the post does not tilt towards one adjacent post or the other. Small tilting of the post 102 in the front or rear direction of the fence can be accommodated by shimming the column portions when attaching the column portions to the post, should such occur. When placing the first column portion 104*a*, the installer can ensure that first column portion 104*a* is plumb, and a shim may be positioned between the post and column portion 104*a* to make appropriate accommodation, if needed. The second column portions may similarly be shimmed, if desired (or a gap may be present between the second column portion 104*b* and the corresponding post 102, depending on circumstances). Thus, minor plumb issues may be compensated for by shimming at least one of the column portions as needed, so that the column 104 (which is seen) is plumb, even though the underlying post 102 (which is hidden, and typically embedded in the concrete footing 117) may not be exactly plumb.

Figure 5:
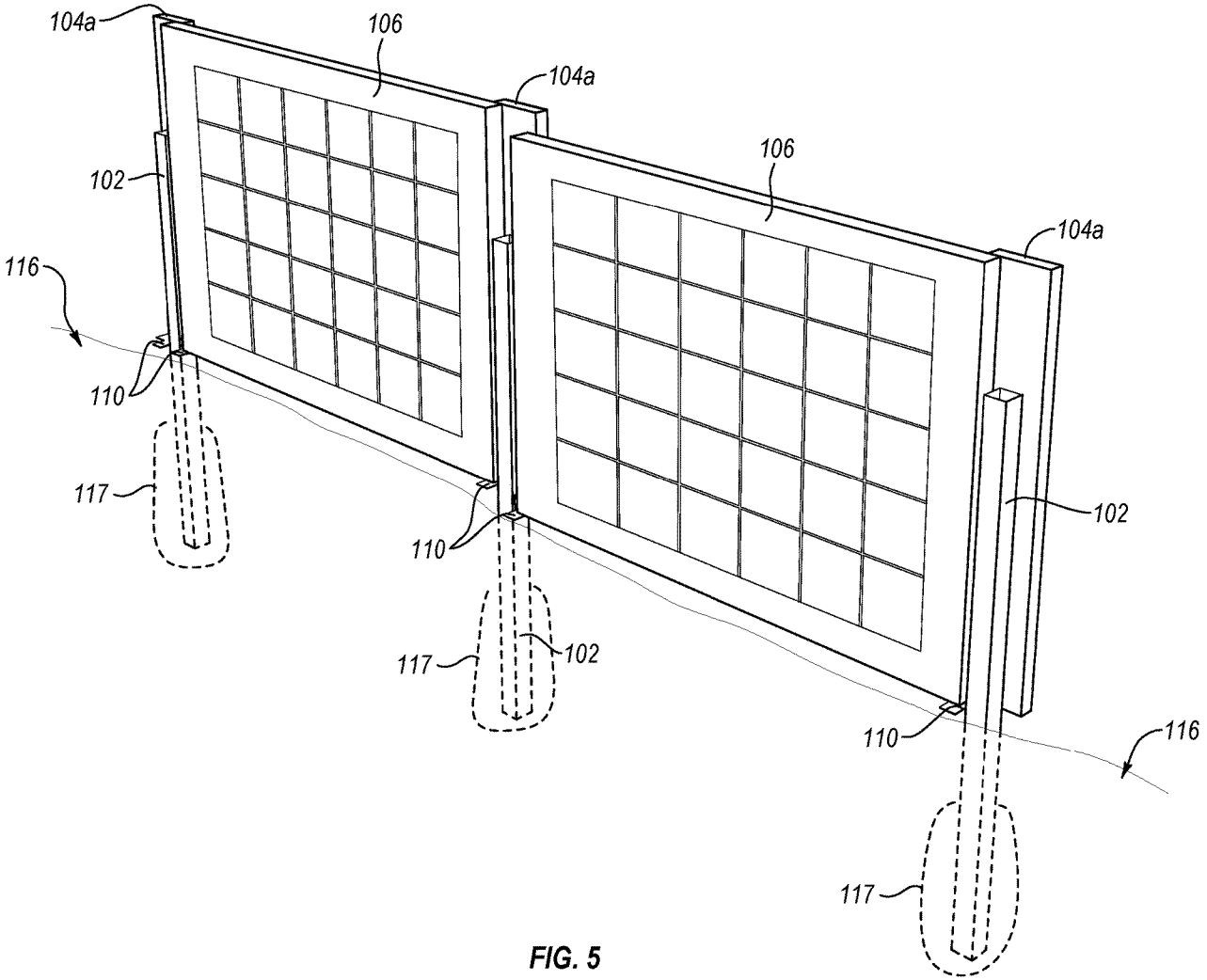
FIG. 5 shows placement of the concrete panel so as to be supported on the brackets of each post, between adjacent posts.

FIG. 5 shows panels 106 being advanced into place, from the open side on which column portions 104*b* have not yet been placed, e.g., against column portions 104*a*, on brackets 110. Panels 106 are advantageously lightweight, so that they can be completely supported on brackets 110 (e.g., on bracket arms 110*b*), attached to posts 102. Because panels 106 are lightweight, the load on each post (through brackets 110) is much smaller than is traditionally applied to the concrete footings of a traditional concrete fence system, where the panels are laid directly on the footings themselves. Where each concrete footing may bear a load of 4,000 lbs or more, the posts in the present configuration typically only bear a load of about 400 lbs each (e.g., where the panel weighs about 250 lbs). Because the panels are lightweight, two crew members can easily lift and place the panel in position on brackets 110.

Figure 6:
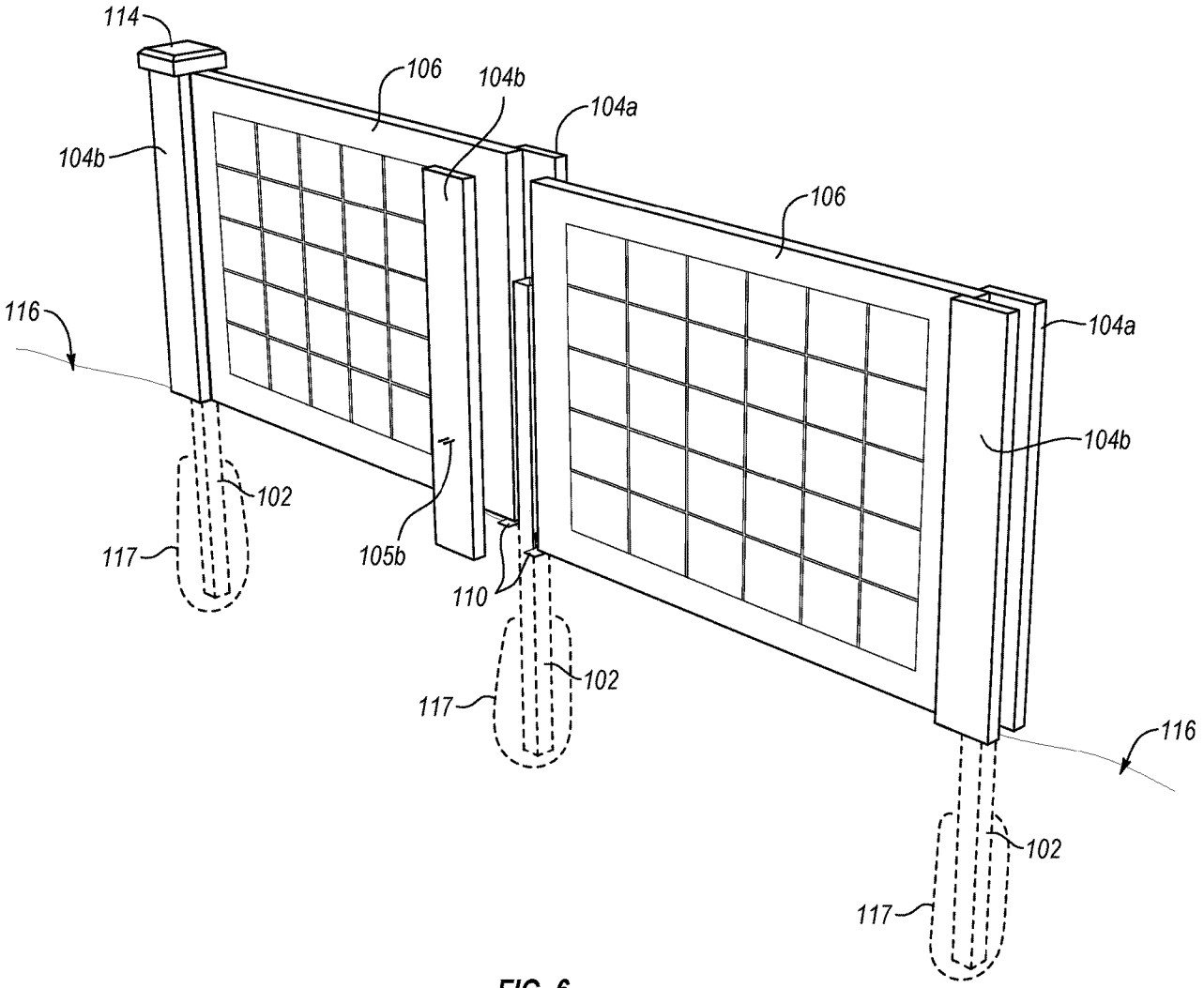
FIG. 6 shows the second portion of the two-part fence column being attached to the post, covering the top portion of the post, sandwiching it within the column.

Referring to FIG. 6, with panels 106 in place, the remaining column portion 104*b* may be attached to the corresponding post 102. Attachment may be by a similar mechanism as described above relative to the first column portion 104*a* (e.g., structural self-tapping screws 105*b*). It will be apparent that the panel 106 may thus simply rest on the brackets 110, rather than being fixedly attached to the posts 102 or columns 104. For example, even once the second column portion 104*b* is positioned and attached over the corresponding post 102, the panels 106 may simply rest within the cavity defined between column portions 104*a*, 104*b*, on brackets 110. Of course, in other embodiments, the panel could be attached to the columns, if desired. There is no need to grout the column voids, as is typically done. Thus, the assembly mechanism may not require the use of any concrete at all (accept where a user elects to use concrete footings), and the various component parts of the fence system may easily be disassembled and reassembled, should it be necessary to replace a damaged panel, column, etc. In other words, the fence system is easily reversible, particularly where the panel and columns are not cemented together, in place. One crew member may steady panel 106 in place, while another crew member secures the second column portion 104*b* in place. Once both column portions 104*a* and 104*b* are in place, sandwiching panel 106, the panel is fully supported, so that no bracing or other temporary support is needed.

The panels 106 may not contact any present concrete footing. Similarly, the columns 104 may not contact any concrete footing. Rather, the entire load is supported by the brackets (e.g., and screws or other attachment mechanism).

Caps 114 may be provided over columns 104 by any suitable mechanism (e.g., they may simply be laid thereover, or may be attached to column 104 by screws or other mechanism, if desired). At an end of a fence line, any gap between column portions 104*a*, 104*b* (which would normally be covered by a panel 106) may be filled or otherwise covered, as desired. In an embodiment, concrete fillers are added at the end of a column to replace the panel.

While FIGS. 2-6 illustrate a particular order of steps (e.g., placing posts 102, attaching brackets 110, attaching column portions 104*a*, positioning panels 106, and attaching the remaining column portions 104*b*), it will be appreciated that the steps of the disclosed method do not necessarily have to proceed in this order, although there may be advantages associated with at least some of the steps being in a particular order For example, brackets 110 may be attached to posts 102 after placement of post 102, as it may not be known exactly to what depth the post may be advanced into a concrete footing or the ground, prior to placement. Similarly, placement of the panel 106 after one panel portion (e.g., 104*a*), but before the second panel portion (e.g., 104*b*) may be preferred, as the panel 106 does not have to be hoisted above the column and dropped into the slot defined between portions 104*a*, 104*b*.

Because the posts are positioned in the ground (e.g., footing) before the load of the panels is applied thereto, no bracing of the fence structure, or clamping of the column portions is required, as is normally provided during initial placement of the panel, and during grouting of the columns, and before the grout in the columns has had sufficient time to harden. As described above, once both column portions are attached to the post, the panel is fully supported. The time required to install such a fence system is significantly less than that required to install a similar fence (even a light weight panel one), where concrete footings are relied on for providing proper leveling characteristics to the panel supported thereon.

The fence system may be formed as a single wall structure, as shown, as opposed to the double wall structures described in U.S. Publication No. 2011/0197533. In other words, the entire fence has a thickness defined by the thickness of a single lightweight panel, rather than being a double wall structure as disclosed in the foregoing application.

While described principally in the context of concrete panels and columns, it will be appreciated that other cement or other masonry materials may similarly be employed, while providing similar benefits. In addition, while the panels and columns in an embodiment may both comprise concrete, it will be appreciated that in another embodiment, at least one thereof may comprise a material other than concrete (e.g., masonry). For example, in an embodiment, the fence system could comprise a concrete panel, and the columns may comprise another material (e.g., masonry, another material, etc.). As such, for simplicity, the term "concrete" as used herein is to be broadly construed to include concrete, as well as other cementitious materials, and masonry, where they provide similar weatherability characteristics.

Numbers, percentages, or other values stated herein are intended to include that value, and also other values that are about or approximately the stated value, as would be appreciated by one of ordinary skill in the art encompassed by embodiments of the present disclosure. A stated value should therefore be interpreted broadly enough to encompass values that are at least close enough to the stated value to perform a desired function or achieve a desired result. The stated values include at least the variation to be expected in a suitable manufacturing process, and may include values that are within 25%, within 20%, within 10%, within 5%, within 1%, etc. of a stated value. Furthermore, the terms "substantially", "similarly", "about" or "approximately" as used herein represents an amount or state close to the stated amount or state that still performs a desired function or achieves a desired result. For example, the term "substantially" "about" or "approximately" may refer to an amount that is within 25%, within 20%, within 10% of, within 5% of, or within 1% of, a stated amount or value.

Ranges between any values disclosed herein are contemplated and within the scope of the present disclosure (e.g., a range defined between any two values (including end points of a disclosed range) given as exemplary for any given parameter).

As used in this specification and the appended claims, the singular forms "a," "an" and "the" include plural referents unless the context clearly dictates otherwise.

All publications, patents and patent applications cited herein, whether supra or infra, are hereby incorporated by reference in their entirety to the same extent as if each individual publication, patent or patent application was specifically and individually indicated to be incorporated by reference.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A method for constructing a column and panel concrete fence, the method comprising:

(i) placing a plurality of posts into a concrete footing;

(ii) attaching a bracket to each post, the bracket being positioned above the concrete footing so as not to make contact with the footing;

(iii) attaching a first portion of a concrete column to each post;

(iv) placing a concrete panel on the brackets of adjacent posts such that a first end of the panel is supported on the bracket of one post and a second end of the panel is supported on the bracket of the adjacent post so that a weight of the panel is completely supported on the brackets; and (v) attaching a second portion of each concrete column to a corresponding post;

wherein the bracket is + shaped, with 4 arms, where 3 of the arms are coplanar, all in a horizontal plane, and the 4th arm is disposed at a 90° upward angle relative to the horizontal plane defined by the 3 coplanar arms.

2. A method as recited in claim 1, wherein the first end of the concrete panel overlaps part of the first portion of the concrete column at a given post, and wherein the second end of the concrete panel overlaps part of the first portion of the concrete column at the adjacent post.

3. A method as recited in claim 1, wherein (iii) and (iv) are performed prior to (v).

4. A method as recited in claim 1, wherein the first portion of the column is screwed into the post.

5. A method as recited in claim 1, wherein the second portion of the column is screwed into the post.

6. A method as recited in claim 1, wherein the bracket is screwed into the post.

7. A method as recited in claim 1, wherein each of the concrete panels is monolithic.

8. A method as recited in claim 1, wherein each concrete panel is lightweight, including a foam core.

9. A method as recited in claim 1, wherein the method does not rely on the concrete footings being level or at a particular height to ensure the concrete panel is level.

10. A method for installing a column and panel concrete fence, the method comprising:

placing a plurality of posts in a concrete footing;

attaching a bracket to each post above the concrete footing so that the bracket does not make contact with the concrete footing, there being a space between a top of the concrete footing and the bottom of the bracket;

attaching a first portion of a concrete column to each post, the first portion of the concrete column corresponding to a front or rear face of the fence;

placing a lightweight concrete panel on the brackets of adjacent posts such that a first end of the panel is supported on the bracket of one post and a second end of the panel is supported on the bracket of the adjacent post so that a weight of the panel is completely supported by the brackets; and attaching a second portion of each concrete column to a corresponding post at a location on the post opposite the first portion of the concrete column, the second portion of the concrete column corresponding to the other of the front or rear face of the fence;

wherein the bracket is + shaped, with 4 arms, where 3 of the arms are coplanar, all in a horizontal plane, and the 4th arm is disposed at a 90° upward angle relative to the horizontal plane defined by the 3 coplanar arms.

11. A method as recited in claim 10, wherein each lightweight concrete panel is configured so that an approximately 9 foot long panel having a height of 6 feet weighs no more than 500 lbs.

12. A method as recited in claim 10, wherein the space between a top of the concrete footing and the bottom of the bracket is at least 1 inch.

13. A column and panel concrete fence comprising:

a plurality of posts each positioned in a respective concrete footing;

a concrete column attached to each post, each column including two portions which are separated from one another, and correspond to front and rear faces of the fence, respectively;

a lightweight concrete panel, a first end of the panel being positioned atop a first bracket attached to one of the plurality of posts at a location such that the first bracket is above its respective concrete footing, with a space between a top of the respective concrete footing and the bottom of the bracket, such that the first end of the panel extends between the portions of the column and a second end of the panel being positioned atop a second bracket attached to an adjacent one of the plurality of posts at a location such that the second bracket is above its respective concrete footing, with a space between a top of the respective concrete footing and the bottom of the second bracket, such that the second end of the panel extends between the portions of the column attached to the adjacent post;

wherein the brackets do not make contact with the footing so that the weight of the panel is completely supported by the brackets;

wherein the brackets are + shaped, with 4 arms, where 3 of the arms are coplanar, all in a horizontal plane, and the 4th arm is disposed at a 90° upward angle relative to the horizontal plane defined by the 3 coplanar arms.

14. A fence as recited in claim 13, wherein each lightweight concrete panel includes a foam core.

15. A fence as recited in claim 13, wherein each of the concrete panels is precast as a monolithic single piece.

16. A fence as recited in claim 13, wherein the first and second portions of the concrete column are each screwed into the post.

17. A fence as recited in claim 13, wherein each lightweight concrete panel is configured so that an approximately 9 foot long panel having a height of 6 feet weighs no more than 500 lbs.

* * * * *